US006312289B1

(12) United States Patent
Saji

(10) Patent No.: US 6,312,289 B1
(45) Date of Patent: Nov. 6, 2001

(54) CAR PLUG AND EXTERNAL ELECTRODE TERMINAL OF CAR PLUG

(76) Inventor: Masahiro Saji, 2-88-1 Enoki Musashimurayamashi, Tokyo (JP)

( * ) Notice: Subject to any disclaimer, the term of this patent is extended or adjusted under 35 U.S.C. 154(b) by 0 days.

(21) Appl. No.: 09/656,748

(22) Filed: Sep. 7, 2000

(30) Foreign Application Priority Data

Jun. 30, 2000 (JP) ..... 12-197847

(51) Int. Cl.[7] ..... H01R 24/04
(52) U.S. Cl. ..... 439/668; 439/218
(58) Field of Search ..... 439/668, 218, 439/621, 622

(56) References Cited

U.S. PATENT DOCUMENTS

| | | | | |
|---|---|---|---|---|
| 5,158,484 | * | 10/1992 | Chou | 439/668 |
| 5,261,838 | * | 11/1993 | Fujie | 439/668 |
| 5,263,879 | * | 11/1993 | Sas et al. | 439/668 |
| 5,704,812 | * | 1/1998 | Moji | 439/668 |
| 5,897,397 | * | 4/1999 | Yokozawa | 439/668 |
| 5,924,895 | * | 7/1999 | Moji | 439/668 |

* cited by examiner

*Primary Examiner*—Tulsidas Patel

(57) ABSTRACT

An external electrode terminal formed by an elastically conductive metal band plate and incorporated in a body has a protuberant portion structured that a tail end of the protuberant portion is formed to extend continuously from a tail end side of the band plate and a tip end of the protuberant portion is formed in the shape of a free end moved freely toward the center of the body. A higher support base surface to support the free end of the protuberant portion in collision with the free end is provided in the body at a position facing the free end of the protuberant portion pressed in the radial direction of the body by the inner wall surface of a somewhat larger cigar lighter socket mounted in a vehicle body for European automobiles when the body is inserted into the somewhat larger socket, and a lower support base surface lower than the higher support base surface by one step is provided at a position to support the free end slipped out of the higher support base surface by extension of the protuberant portion toward the free end in the state that the protuberant portion is pressed forcibly in the radial direction of the body by the inner wall surface of a somewhat smaller socket mounted in a vehicle body for Japanese and U.S. automobiles when the body is inserted into the somewhat smaller socket.

10 Claims, 8 Drawing Sheets

CAR PLUG AND EXTERNAL ELECTRODE TERMINAL OF CAR PLUG

BACKGROUND OF THE INVENTION

1. Field of the Invention

This invention relates to an improved car plug used to derive power by utilizing a socket, that is, a jack portion for a cigar lighter, mounted in a cabin of an automobile, for a socket to derive power, i.e., by inserting the plug, instead of the cigar lighter, into the socket after removal of the cigar lighter from the socket.

2. Description of the Prior Art

A cigar lighter socket 1 mounted in a cabin of an automobile has a cylindrical main body 10 serving as an external electrode and formed by a metal material and is assembled as shown in FIG. 1. In this case, an axial rod-shaped internal electrode 11 is mounted as one body to the bottom of the main body through an insulating material 12. Further, a holding piece 13 formed in the shape of a plate by an elastic metal material for holding the cigar lighter inserted into the main body 10 is mounted to the inner end side of the internal electrode 11. Further, a cord holder 15 is mounted to the outer end side of the internal electrode 11 projecting from the outer surface of the bottom of the main body 10 through an insulating material 14 with a nut 16 to hold an earth wire electrically connected to the main body 10 and a cord 17 electrically connected to the internal electrode 11 in the cord holder, resulting in a completion of assemblage of the socket which is then mounted in a vehicle body.

A car plug A inserted into the socket to derive power has a body 2 formed in an axially cylindrical shape by an insulating material and is assembled as shown in FIG. 2. In this case, an internal electrode terminal 3 formed by a conductive metal material is mounted to the tip end (i.e., the left end side in FIG. 2) of the body as being moved freely inwardly and outwardly. Further, one cord wire 40 of a cord 4 inserted into the body 2 from its tail end side (i.e., the right end side in FIG. 2) is connected to the internal electrode terminal through a fuse 30 in the state that the internal electrode terminal is urged to be pushed out by a spring 31. Then, external electrode terminals 5, 5 formed by an elastically conductive metal band plate are incorporated into the body 2 such that protuberant portions 50, 50 at the tip end side of the external electrode terminals are extended from the circumference of the body 2 through window holes 20, 20 provided in a peripheral wall of the body 2, and the tail ends of the external electrode terminals are connected to the other cord wire 41 of the cord 4 by soldering, resulting in a completion of assemblage of the car plug. When the car plug is inserted into the above socket 1 shown in FIG. 1, the internal electrode terminal 3 at the tip end of the car plug is brought into electrical contact with the internal electrode 11 at the bottom of the cylindrical main body 10 of the socket 1, and the protuberant portions 50, 50 extending from the circumference of the body 2 are also brought into electrical contact with the inner surface of the cylindrical main body 10 of the socket 1. For that reason, the car plug is used to derive power through the cord 4.

Incidentally, the cigar lighter socket 1 mounted in a vehicle body of Japanese and U.S. automobiles is standardized to have the main body 10 having an inside diameter of 21 mm. On the other hand, a socket 1' used for European automobiles such as Benz is formed to have the main body having a somewhat larger inside diameter (about 22 mm), as shown in FIG. 3.

For that reason, in case of attempting to derive power by inserting the car plug A formed to be adapted for the Japanese automobiles to derive power into the socket 1' for the European automobiles, the protuberant portions 50, 50 of the car plug A are brought into insufficient contact with the inner surface of the main body 10 of the socket 1'. As a result, there are problems such as a drop of the car plug A out of the socket or a failure in electrical connection between the protuberant portions 50, 50 and the main body 10.

In this connection, the car plug A has a support member s in the body 2 to support the external electrode terminal 5 such that the protuberant portion 50 may be extended from the window hole 20 of the body 2. The support member is also axially supported with a rotary shaft r rotated by operations from the outside of the body 2 to shift a supporting position in the radial direction of the body by the pivotal motion of the support member, as shown in FIG. 4. Thus, the car plug is structured to cope with variations in inside diameter of the main body 10 of the socket 1 by switch-over of the supporting position such that the extension level of the protuberant portion 50 from the window hole 20 may be switched over between higher and lower levels.

When the above car plug A in the prior art is inserted into the somewhat larger socket 1' for the European automobiles, the extension level of the protuberant portion 50 is switched over to the higher level by operating an operating portion to move the support member s to a position in the state shown in FIG. 4 so as to support the longitudinal portion of the external electrode terminal 5 as being pushed out in the radial direction. When the car plug A is inserted into the somewhat smaller socket 1 for the Japanese and U.S. automobiles, the extension level of the protuberant portion 50 is switched over to the lower level by operating the operating portion similarly to place the support member s in the state shown in FIGS. 2 and 6 so as to separate the support member s from the external electrode terminal 5. Thus, the above car plug A is adapted for both the somewhat smaller socket 1 and the somewhat larger socket 1' by switch-over operation. However, since the above switch-over operation is complicated, and the support member s mounted in the body 2 to be out of sight needs to be moved from the outside of the body 2 for the switch-over operation, it is difficult to make sure of the switched-over state. Thus, a mistake in inserting the car plug set to be adapted for the somewhat larger socket 1' into the somewhat smaller socket 1 is made in some cases. In this case, there is a problem in that the forcible insertion of the car plug causes a breakage of the car plug or makes a removal of the car plug from the socket impossible.

SUMMARY OF THE INVENTION

The present invention is made to overcome the above problems caused in the prior art. It is an object of the present invention to provide a new measure, which is structured that switch-over of the extension level of a protuberant portion of an external electrode terminal of a car plug between higher and lower levels to be adapted for sockets of different inside diameters may be made automatically during insertion of the car plug into the socket.

According to the present invention, for achieving the above object, there is provided a car plug having the following structure. That is, an external electrode terminal formed by an elastically conductive metal band plate and incorporated in a body has a protuberant portion structured that a tail end of the protuberant portion is formed to extend continuously from the tail end side of the band plate, and a tip end of the protuberant portion is formed in the shape of a free end moved freely toward the center of the body, a higher support base surface to support the free end of the protuberant portion in collision with the free end is provided in the body at a position facing the free end of the protuberant portion pressed in the radial direction of the body by the inner wall surface of a somewhat larger cigar lighter socket mounted in a vehicle body for European automobiles when the body is inserted into the above somewhat larger socket, while a support base surface lower by one step than the above higher support base surface is provided at a position to support the free end slipped down from the above higher support base surface by extension of the protuberant portion toward the free end in the state that the protuberant portion is pressed forcibly in the radial direction of the body by the inner wall surface of a somewhat smaller cigar lighter socket mounted in a vehicle body for Japanese and U.S. automobiles when the body is inserted into the above somewhat smaller socket.

BRIEF DESCRIPTION OF THE DRAWINGS

The foregoing and other objects and features of the invention will become apparent from the following description of preferred embodiments of the invention with reference to the accompanying drawings, in which.

DESCRIPTION OF THE PREFERRED EMBODIMENTS

Figure 1:
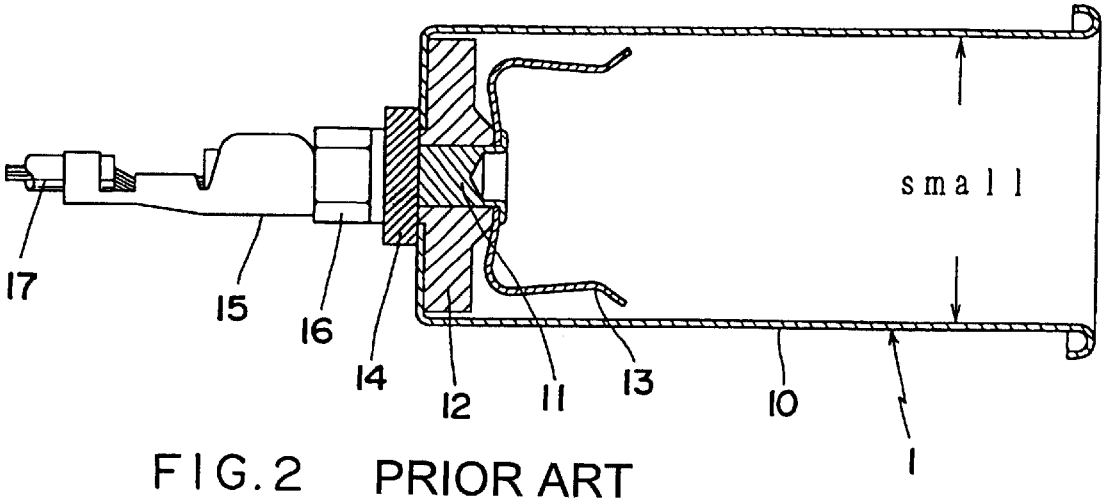
FIG. 1 PRIOR ART
FIG. 1 is a longitudinal sectional side view showing a somewhat smaller cigar lighter socket mounted in Japanese and U.S. automobiles.
Figure 2:
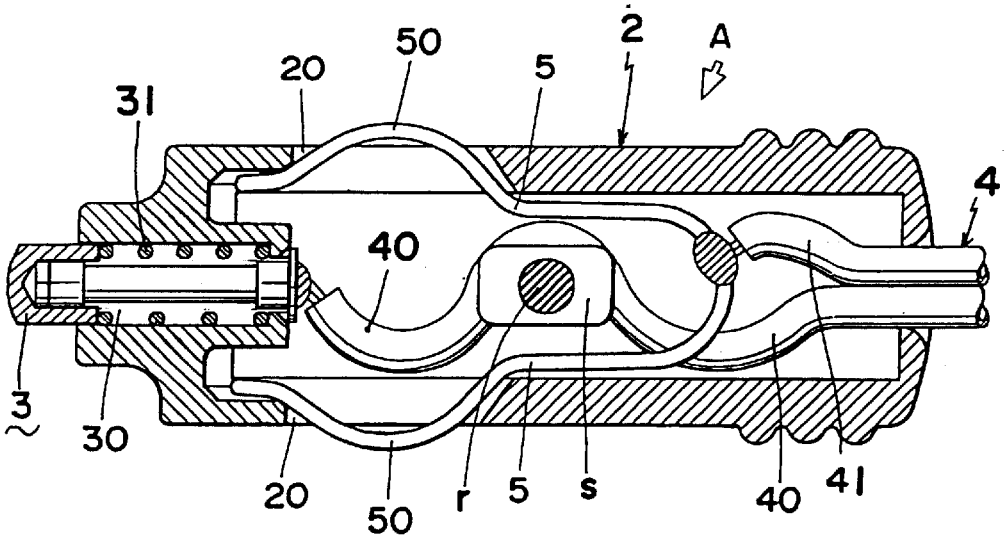
FIG. 2 PRIOR ART
FIG. 2 is a longitudinal sectional side view showing a car plug in the prior art.
Figure 3:
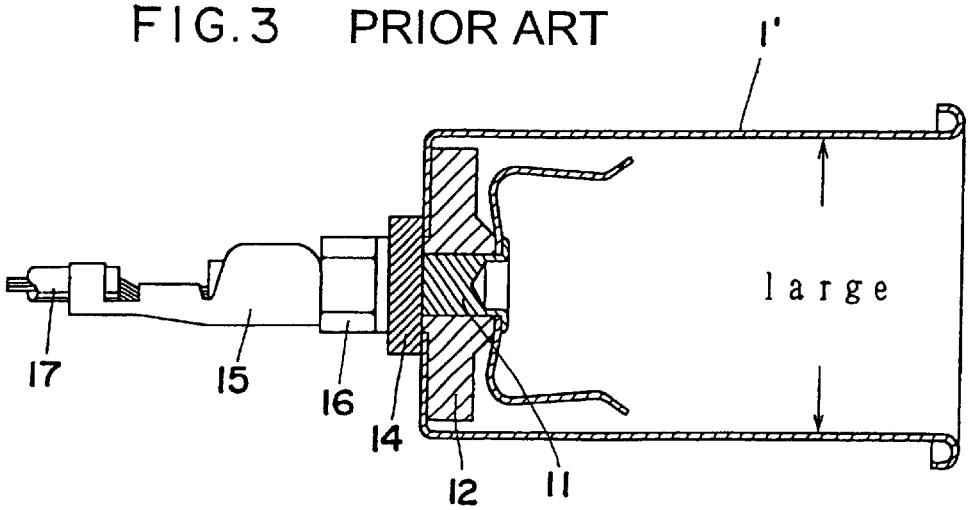
FIG. 3 PRIOR ART
FIG. 3 is a longitudinal sectional side view showing a somewhat larger cigar lighter socket mounted in European automobiles.
Figure 4:
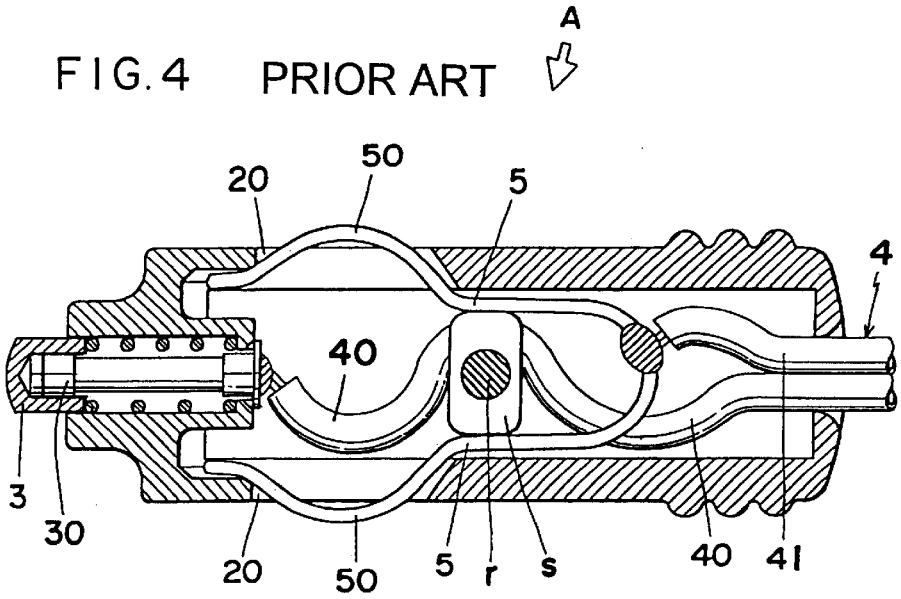
FIG. 4 PRIOR ART
FIG. 4 is a longitudinal sectional side view showing the car plug in the prior art when switched over to be adapted for the somewhat larger socket.
Figure 5:
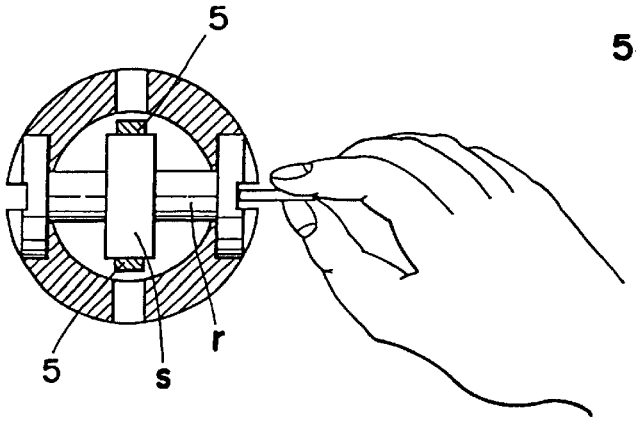
FIG. 5 PRIOR ART
FIG. 5 is a longitudinal sectional front view showing the car plug in the prior art in the state of FIG. 4.
Figure 6:
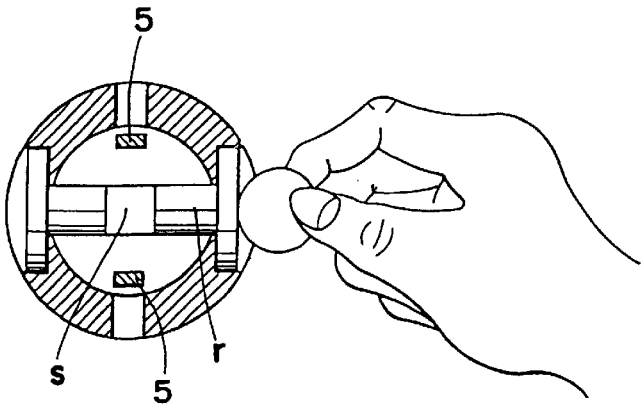
FIG. 6 PRIOR ART
FIG. 6 is a longitudinal sectional front view showing the car plug in the prior art when switched over to be adapted for the somewhat smaller socket.
Figure 7:
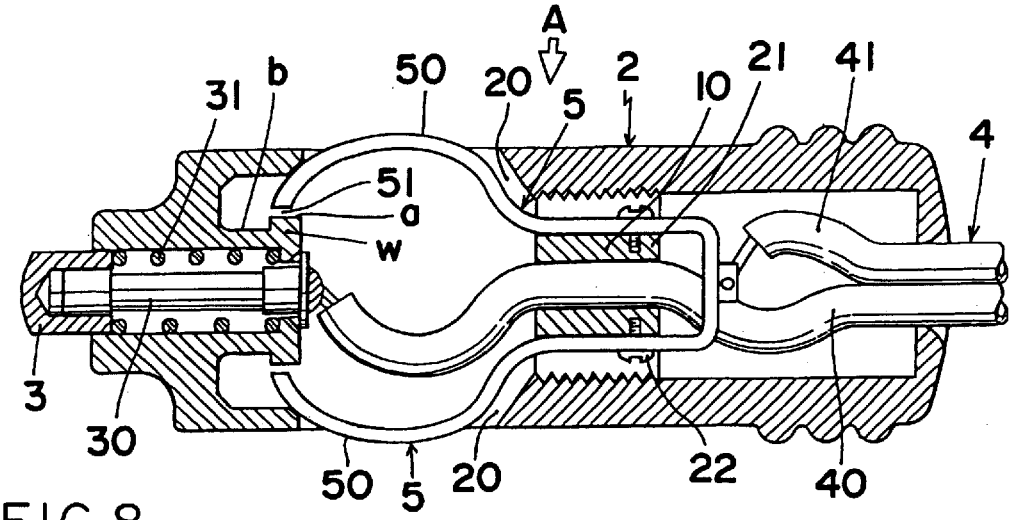
FIG. 7 is a longitudinal sectional side view showing an embodiment of a car plug according to the present invention.

Similarly to the prior art, a car plug A to derive power according to the present invention has a body 2, which is inserted, instead of a cigar lighter, removably into a cigar lighter socket 1 structured as shown in FIGS. 1 and 3 and mounted in a cabin of a vehicle body of an automobile, and the body 2 is formed in an axially cylindrical shape by an insulating material such as a resin material as shown in FIG. 7. The car body A of the present invention is assembled also similarly to the prior art by mounting an internal electrode terminal 3 formed by a conductive metal material to the tip end of the body as being moved freely inwardly and outwardly, then connecting one cord wire 40 of a cord 4 inserted into the body 2 from its tail end side to the internal electrode terminal through a fuse 30 in the state that the internal electrode terminal is urged to be pushed out by a spring 31, then incorporating an external electrode terminal 5 formed by an elastically conductive metal band plate and having a circular arc-shaped protuberant portion at the tip end side in the body 2 such that the tail end side of the external electrode terminal is mounted to a base 21 provided in the body 2 by set screws 22 or the like to support the external electrode terminal without permitting the movement in the longitudinal direction of the band plate, then connecting the other cord wire 41 of the cord 4 to the tail end of the external electrode terminal, and then bringing the protuberant portion 50 into a state to extend outwardly from a window hole 20 provided in the peripheral wall of the body 2, whereby the assembled car plug is used to derive power by inserting the above plug, instead of the cigar lighter, into the cigar lighter socket 1 mounted in the vehicle body of the automobile.

However, the external electrode terminal 5 formed in the shape of a band plate by an elastic metal material and mounted in the body 2 is structured to bring the circular arc-shaped protuberant portion 50 of the external electrode terminal into pressure contact with the inner wall surface of the socket 1 under a predetermined spring pressure in the state that a free end 51 of the protuberant portion 50 is supported with a support base w provided in the body 2 in contact with the support base when the protuberant portion is pressed in the radial direction in pressure contact with the inner wall surface of the socket 1 by insertion of the body 2 into the socket 1.

Figure 8:
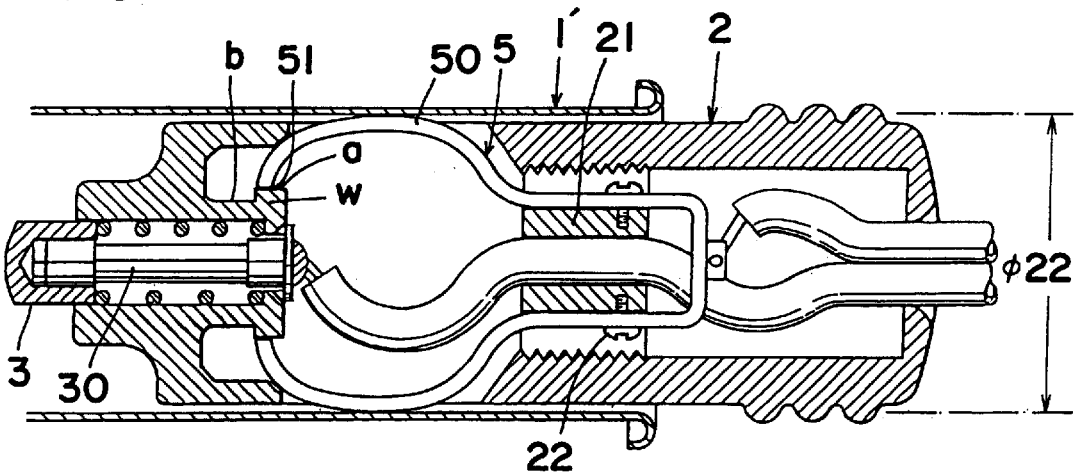
FIG. 8 is a longitudinal sectional side view showing the car plug according to the present invention when inserted into the somewhat larger socket mounted in the European automobiles.

The support base w to support the free end 51 of the protuberant portion 50 of the external electrode terminal 5 in contact with the free end has a support base surface formed in two lower and higher steps. A support base surface a of the first step is adapted to support the free end 51 of the protuberant portion 50 of the external electrode terminal 5 in contact with the free end in the state that the outer surface of the protuberant portion 50 is pressed against the inner side of the body 2 of the car plug A in pressure contact with the inner wall surface of the cigar lighter socket 1 having the inside diameter of 21 mm and mounted in the vehicle body for the Japanese and U.S. automobiles, when the body 2 is inserted into the socket 1, as shown in FIG. 8. The level of the support base surface of the first step is set to exert a spring pressure for holding a predetermined draw-out force so as to bring the protuberant portion 50 into pressure contact with the inner wall surface of the socket.

Figure 9:
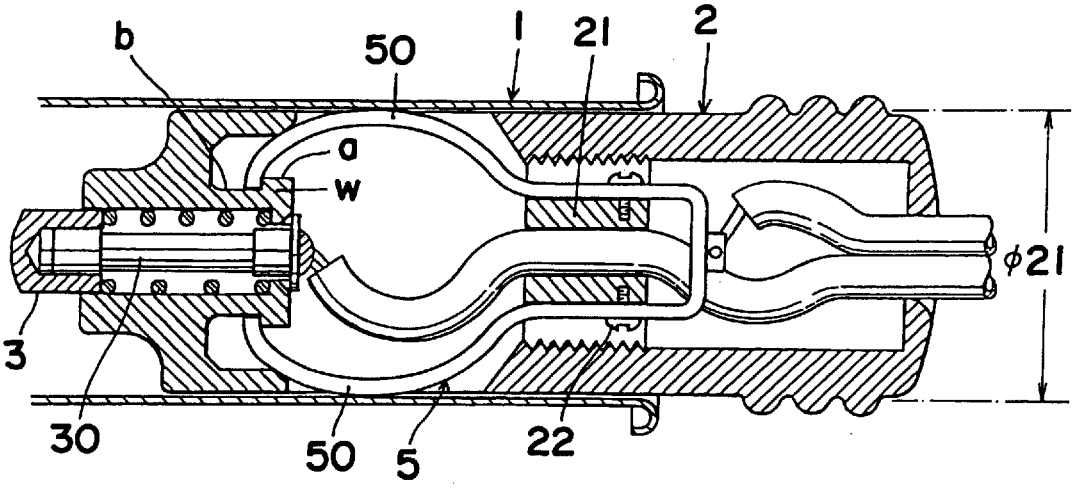
FIG. 9 is a longitudinal sectional side view showing the car plug according to the present invention when inserted into the somewhat smaller socket mounted in the Japanese and U.S. automobiles.

A support base surface b of the second step is provided to be placed next to the support base surface a in a direction in which the protuberant portion 50 is depressed in the radial direction of the body 1 so as to be extended to the side having the free end 51 in the state that the protuberant portion 50 is pressed forcibly by insertion of the body 2 of the car plug A into the socket 1' having an inside diameter of 22 mm and mounted in the vehicle body for the European automobiles. Also, the support base surface b is set to be placed such that the free end 51 shifted in the direction of extension of the protuberant portion 50 may be slipped down to the lower support base surface b of the second step due to the extension of the protuberant portion 50 as shown in FIG. 9. Further, the level of the support base surface b is set to allow the predetermined draw-out force to be held in the state that the free end 51 slipped down as described above is supported with the support base surface b to bring the outer surface of the protuberant portion 50 into pressure contact with the inner wall surface of the socket 1'.

With the above structure, when the body 2 of the car plug A is inserted into the somewhat larger socket 1' for the European automobiles, the free end 51 of the protuberant portion 50 is moved toward the center of the body 2 in the state that the protuberant portion 50 is pressed in the radial direction of the body 2 by pressure contact of the outer surface of the protuberant portion with the inner wall surface of the socket 1', as shown FIG. 8. In this case, the free end 51 is supported with the support base surface a of the support base w to stop its subsequent motion. The predetermined spring pressure is then exerted to bring the circular arc-shaped protuberant portion 50 into pressure contact with the inner wall surface of the socket 1', resulting in a state to be adapted for the somewhat larger socket 1' for the European automobiles.

On the other hand, when the body 2 of the car plug A is inserted into the somewhat smaller socket 1 for the Japanese and U.S. automobiles, the protuberant portion 50 is extended to the side having the free end 51 in the state that the protuberant portion 50 is pressed forcibly in the radial direction of the body 2. With the extension of the protuberant portion, the free end 51 is slipped down from the support base surface a to the lower support base surface b formed to extend continuously ahead of the support base surface a in the direction of extension of the protuberant portion. Then, the protuberant portion 50 is switched over to a state to exert the predetermined spring pressure by collision of the free end 51 of the protuberant portion with the lower support base surface b as shown in FIG. 9, resulting in automatic switch-over to a state to be adapted for the somewhat smaller socket for the Japanese and U.S. automobiles.

Figure 10:
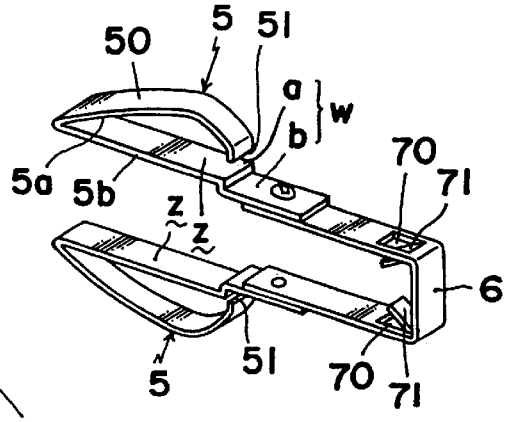
FIG. 10 is a perspective view showing an external electrode terminal of the car plug according to the present invention.

The external electrode terminal 5 is formed to have the protuberant portion 50 by bending a conductive metal band plate in a circular arc shape as shown in FIG. 10. In this case, the protuberant portion 50 is formed by bending, in a circular-arc shape, a folded-back side 5*a* obtained by folding back the metal band plate z from its longitudinal portion after being subjected to bending outwardly. The end of the circular arc-shaped protuberant portion 50 may be bent toward the tail end side of the band plate z to provide the free end 51.

The support base w facing the free end 51 to support the free end 51 in the contact therewith may be provided at a tail end side 5*b* facing the folded-back side 5*a* of the band plate z by cranking a portion of the tail end side 5*b* facing the free end 51.

Figure 11:
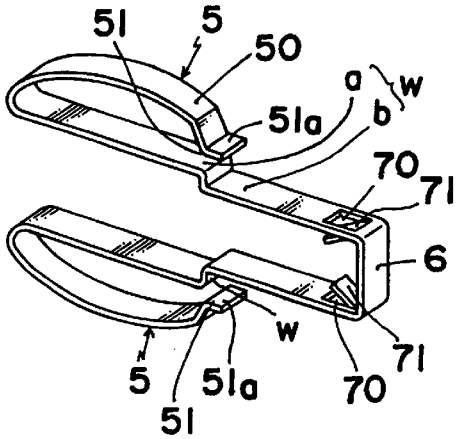
FIG. 11 is a perspective view showing another embodiment of the external electrode terminal of the car plug according to the present invention.

Otherwise, the external electrode terminal 5 may be formed to have a pair of protuberant portions 50, 50 at the opposite ends of a single band plate as shown in FIG. 11. In this case, the protuberant portions 50 are formed by bending, in a circular arc shape, folded-back sides 5*a* obtained by bending an intermediate portion of a lengthened band plate in a U-like shape to face the opposite ends each other, and then folding back the opposite ends to the U-shaped bent portions after being subjected to bending outwardly.

In this place, the free ends 51, 51 at the tip end side of the protuberant portions 50, 50 are bent outwardly to provide substantially horizontal guide pieces 51*a*, 51*a*, as shown in FIG. 11. Each guide piece 51*a* serves as a guide for smooth slip-down of the free end 51 from the support base surface a of the support base w formed by cranking the intermediate portion of the band plate to the support base surface b lower than the support base surface a, when the protuberant portion 50 is pressed forcibly to be extended as being slipped down from the support base surface a from the state that the free end 51 is brought into collision with the support base surface a.

Figure 12:
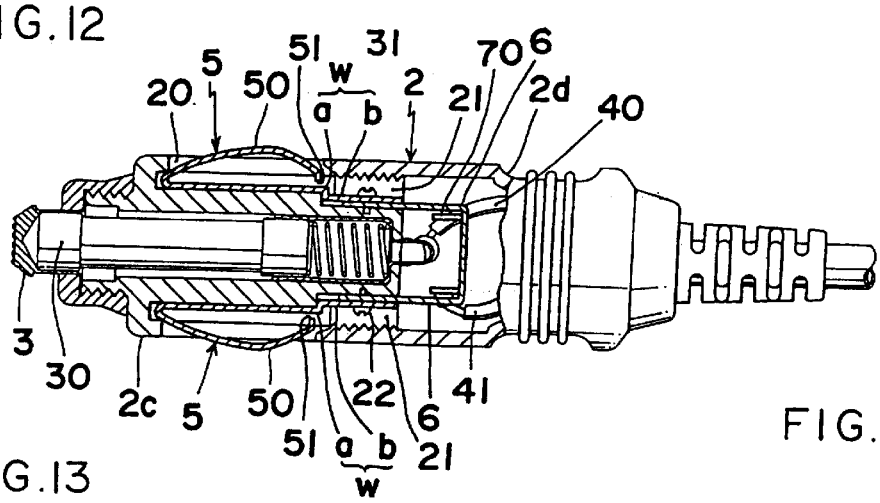
FIG. 12 is a side view, partly broken-away, showing a different embodiment of the car plug according to the present invention.
Figure 13:
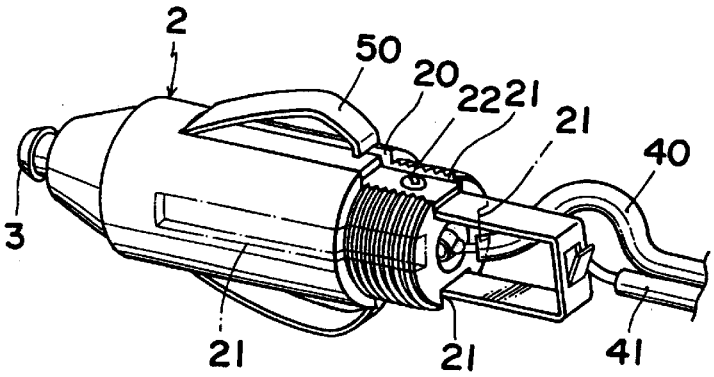
FIG. 13 is a perspective view showing an essential part of the car plug according to the present invention.

On the contrary to the case shown in FIGS. 7 to 9, the external electrode terminal 5 may be mounted to the body 2 such that the free end 51 of the protuberant portion 50 of the external electrode terminal is located at the rear end of the protuberant portion 50 in the direction of insertion of the body 2 into the socket 1, as shown in FIGS. 12 and 13. By mounting the external electrode terminal 5 in this manner, it is possible to utilize a force in insertion of the body 2 into the somewhat smaller socket 1 having the inside diameter of 21 mm for slip-down of the free end 51 of the protuberant portion 50 from the higher support base surface a to the lower support base surface b of the support base w in the state that the protuberant portion 50 is pressed forcibly in the radial direction of the body 2 to be extended to the side having the free end 51 when the body 2 of the car plug A is inserted into the somewhat smaller socket 1, resulting in smooth slip-down of the free end 51 to the support base surface b.

The external electrode terminals 5, 5 having the above structure are mounted to the body 2 as shown in FIGS. 12 and 13 by bringing the tail end sides 5*b* of the band plate z into contact with mounting seats 21, 21 formed in the body 2 to fasten the tail end sides to the mounting seats with set screws 22 or the like without permitting the movement in the longitudinal direction of the band plate. In this case, a separately formed connection terminal 6 is connected to the tail end sides to connect the other cord wire 41 of the cord 4 to the connection terminal by soldering. Otherwise, when the external electrode terminals 5, 5 are formed at the opposite ends facing each other by bending the intermediate portion of the single band plate z in the U-like shape as described above, the connection terminal 6 is obtained by the U-shaped bent portion to extend as one body from the tail end sides. In this case, the other code wire 41 of the cord 4 may be connected to the connection terminal 6 obtained by the U-shaped bent portion by soldering or the like.

Figure 14:
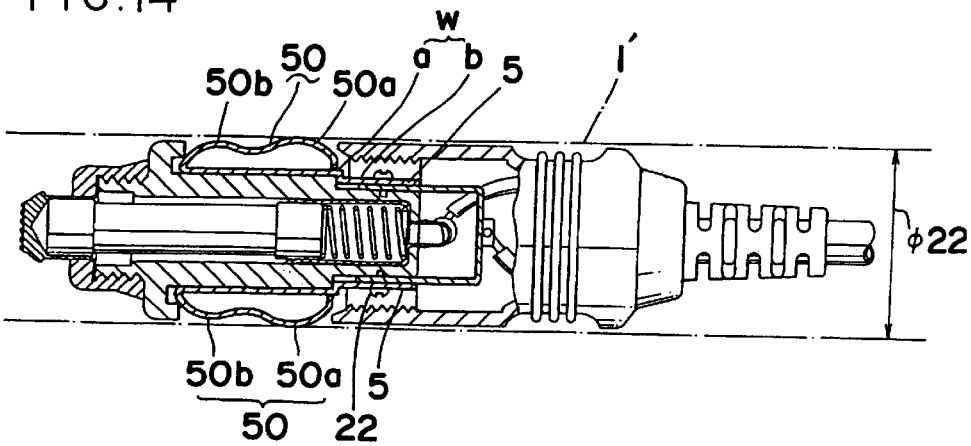
FIG. 14 is a plan view, partly broken-away, showing the car plug according to the present invention when inserted into the somewhat larger socket mounted in the European automobiles.
Figure 15:
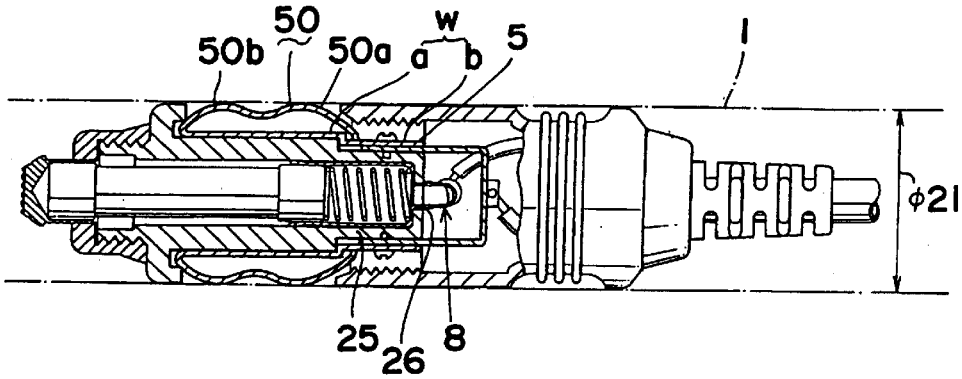
FIG. 15 is a plan view, partly broken-away, showing the car plug according to the present invention when inserted into the somewhat smaller socket mounted in the Japanese and U.S. automobiles.

Further, each protuberant portion 50 of the external electrode terminals 5, 5 may be formed in an appropriate shape such that a higher protuberant portion 50*a* and a protuberant portion 50*b* somewhat lower than the higher protuberant portion 50*a* are provided in parallel arrangement in the longitudinal direction of the band plate z as shown in FIGS. 14 and 15. In this case, the higher protuberant portion 50*a* may be placed at the side having the free end 51, while the lower protuberant portion 50*b* may be placed at the side opposite to the free end 51 as shown in FIG. 14.

When each protuberant portion 50 of the external electrode terminals 5 is formed such that the higher and lower protuberant portions 50*a*, 50*b* are in parallel arrangement as described above, the higher protuberant portion 50*a* brings the free end 51 into contact with the support base surface a of the support base w in the state that the outer surface of the higher protuberant portion is pressed in pressure contact with the inner wall surface of the somewhat larger socket 1' having the inside diameter of 22 mm and mounted in the vehicle body for the European automobiles as shown in FIG. 14 when the body 2 of the car plug A is inserted into the socket 1'. In this state, the spring pressure for holding the predetermined draw-out force is exerted to bring the higher protuberant portion into pressure contact with the inner wall surface of the socket 1'. In this case, the extension level of the higher protuberant portion 50*a* and the length of a leg piece for the free end 51 of the protuberant portion 50*a* need to be set such that a slight clearance is provided between the outer surface of the lower protuberant portion 50*b* and the inner wall surface of the socket 1'.

On the other hand, the lower protuberant portion 50*b* is formed to exert the spring pressure for holding the predetermined draw-out force so as to bring the outer surface of the lower protuberant portion 50*b* into pressure contact with the inner wall surface of the somewhat smaller socket 1 having the inside diameter of 21 mm and mounted in the Japanese and U.S. automobiles. In this case, the free end 51 is shifted toward the outside of the support base surface a and then finally slipped down from the support base surface a to the lower support base surface b as shown in FIG. 15 in the state that the higher protuberant portion 50*a* is pressed forcibly in pressure contact with the inner wall surface of the socket 1 when the body 2 of the car plug A is inserted into the socket 1.

Figure 18:
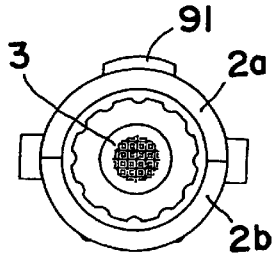
FIG. 18 is a front view showing the car plug according to the present invention.
Figure 20:
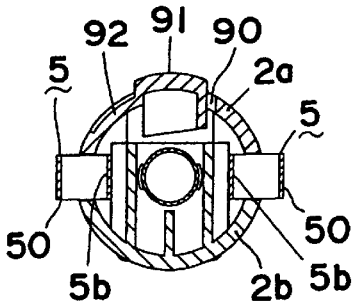
FIG. 20 is a sectional view, taken along a line I—I in FIG. 19, showing the car plug according to the present invention.
Figure 21:
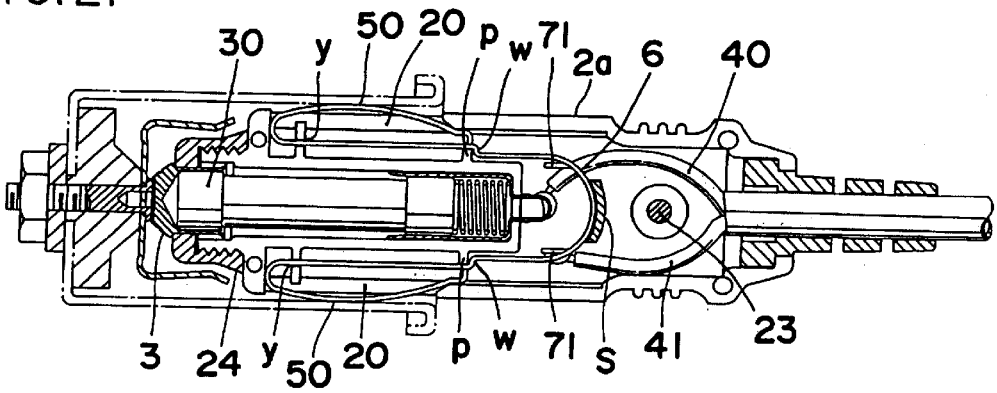
FIG. 21 is a transverse sectional plan view showing the car plug according to the present invention when inserted into the somewhat larger socket mounted in the European automobiles.

In mounting of the external electrode terminals 5, 5 to the body 2 in case of assembling the body 2 by face-to-face connecting a left half 2*a* and a right half 2*b*, which are individually formed in the shape obtained by bisecting the body 2 left and right through a surface of bisection extending in the axial direction of the body as shown in FIGS. 16 to 20, together in an axially cylindrical shape with a connecting screw 23 and a cap 24 united by screwing as shown in FIG. 18, there are provided window holes 20 to expose the protuberant portions 50 of the external electrodes 5 to the outside. The window hole is formed in the shape of bisecting one window hole left and right in the surface of contact between the left half 2*a* and the right half 2*b*. There are also provided mounting seats y, y in a fit-grooved shape in the body 2. Each mounting seat is fitted to the side edge of the tail end side 5*b* facing the protuberant portion 50 of the external electrode terminal 5 for anchoring, when the protuberant portion 50 of the external electrode terminal 5 is formed by bending, in the circular-arc shape, the folded-back side 5*a* obtained by folding back outwardly the portion of the elastically conductive metal band plate z so as to face the folded back side to the tail end side 5*b* after being subjected to bending outwardly. In this case, each of the external electrode terminals 5, 5 may be mounted to the body 2 by fitting the side edge of the tail end side 5*b* facing the protuberant portion 50 of the external electrode terminal 5 into the mounting seat y as shown in FIGS. 21 and 22 to set the external electrode terminal 5 at the position of the predetermined state and then assembling the body 2 with the cap 24 and the connection screw 23 by putting the right half 2*b*, formed in a symmetrical shape, of the body 2 on the left half to face-to-face connect each other such that the mounting seat y formed in the fit-grooved shape in the body may be fitted to the side edge of the tail end side 5*b* of the set external electrode terminal 5.

Figure 22:
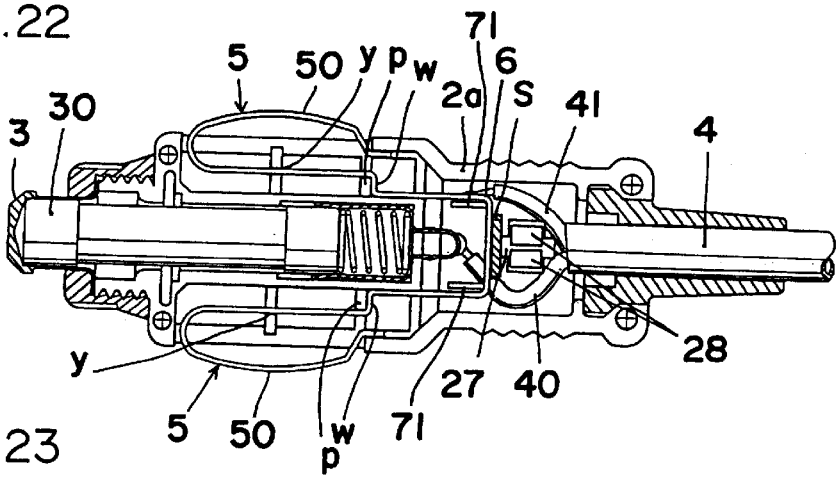
FIG. 22 is a transverse sectional plan view showing a different connection means for connection between one half and the other half obtained by bisecting the body of the car plug according to the present invention left and right.

When a pair of external electrode terminals 5 are formed at the opposite ends of the longer metal band plate z by folding back the opposite ends described above obtained by bending the intermediate portion of the band plate z in the U-like shape, and the U-shaped bent portion is adapted for the connection terminal 6 extending as one body from the external electrode terminals, the rear end face of the U-shaped bent portion of the external electrode terminals is formed as plane as possible as shown in FIG. 22. In this case, there is provided a stopper S colliding with the rear end face. The stopper S is formed to extend as one body from the inner surface of one of the left half 2*a* and the right half 2*b* respectively formed in a shape obtained by bisecting the body left and right. The stopper may be adapted to prevent the rearward movement of the external electrode terminal 5 by bringing the stopper into collision with the rear surface of the U-shaped bent portion of the external electrode terminal 5 mounted and set by fitting the tail end side 5*b* facing the protuberant portion 50 to the above mounting seat y.

Figure 24:
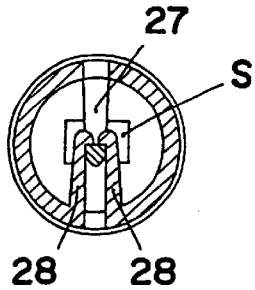
FIG. 24 is a longitudinal sectional rear view showing the car plug according to the present invention.
Figure 23:
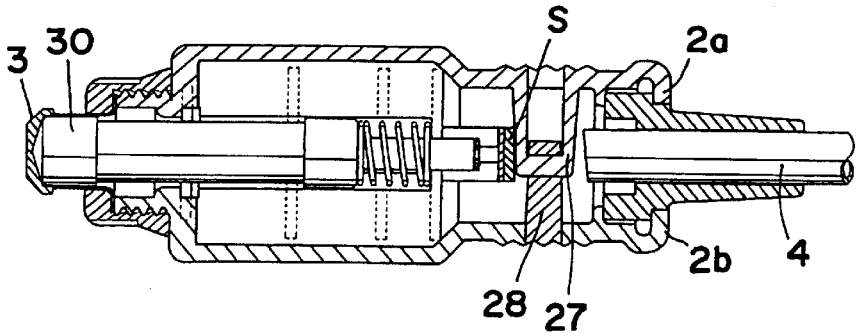
FIG. 23 is a longitudinal sectional side view showing the car plug according to the present invention.

When a looped engagement ring 27 is provided on the inner surface of one of the left half 2*a* and the right half 2*b* individually formed in the shape obtained by bisecting the body 2 left and right as shown in FIG. 23, and hooked engagement projections 28, 28 are provided to face each other on the inner surface of the other to be brought into engagement with the engagement groove 27 as shown in FIG. 24 such that the engagement of the engagement ring 27 with the engagement projections 28, 28 is applied to face-to-face connect the left half 2*a* and the right half 2*b* as one body together, the stopper S may be formed as one body on the front surface side of the engagement ring 27.

Figure 35:
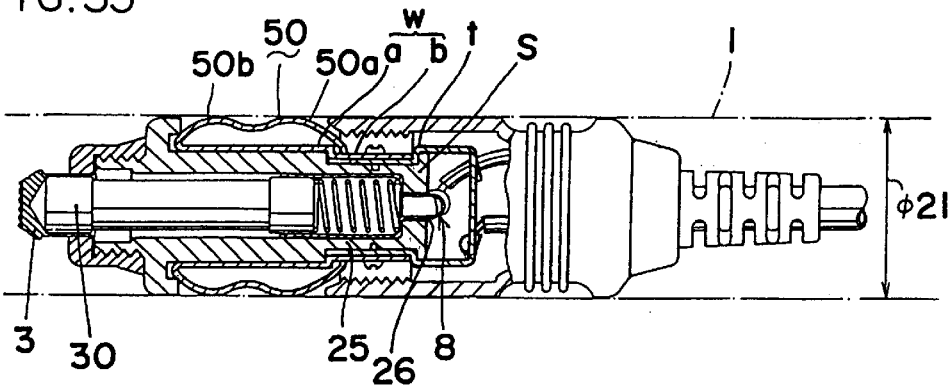
FIG. 35 is a transverse sectional plan view showing a different embodiment of the car plug according to the present invention.

When the stopper S for preventing the external electrode terminal 5 from being moved rearwards is applied to the case of forming the body 2 from a front half and a rear half, there is provided a crank-shaped bent portion t, a notch or a projection piece on the rear end of the metal band plate z used to form the external electrode terminal 5 as shown in FIG. 35. In this case, the stopper S brought into collision or engagement with the rear face of the crank-shaped bent portion, the notch or the projection piece may be formed in the shape of a radial projection on the rear surface of a housing of the fuse 30 by a resin material used to form the fuse housing.

Figure 36:
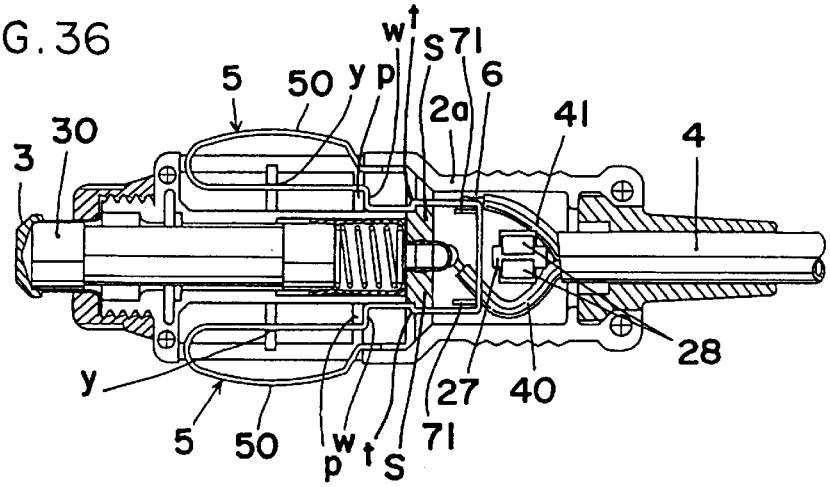
FIG. 36 is a transverse sectional plan view showing a further different embodiment of the car plug according to the present invention.

In the stopper S applied to the case of forming the body 2 from the left half and the right half, there may be also provided the bent portion t, the notch or the projection piece as described above on the rear end side of the band plate z used to form the external electrode terminal 5. In this case, the similar effect may be produced by forming the stopper S by a resin material at a position brought into collision or engagement with the rear surface of the bent portion t, as shown in FIG. 36, in a cavity of one half side of the body 2 set by fitting the external electrode terminal 5 therein.

Figure 25:
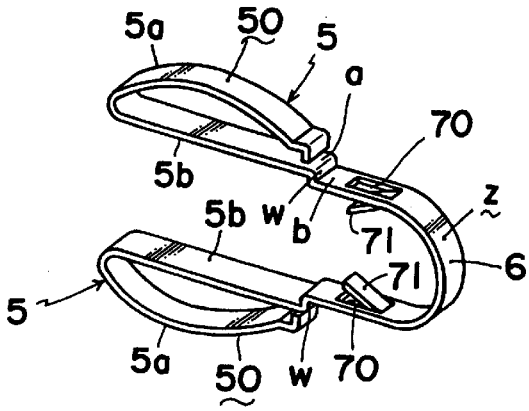
FIG. 25 is a perspective view showing an external electrode terminal of the car plug according to the present invention.
Figure 26:
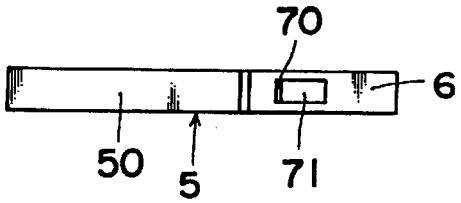
FIG. 26 is a side view showing the external electrode terminal of the car plug according to the present invention.

When the connection terminal 6 is formed by the elastic metal band plate z to extend as one body from the external electrode terminals 5, 5 as described above, there are provided a cut portion 70 and a rise portion 71 in a band plate portion z serving as the connection terminal 6 as shown in FIGS. 25 and 26. In this case, it is effective to fill solder for connection between the rise portion 71 and the cut portion 70 for accurate connection between the connection terminal and the cord wire 41 of the cord by soldering.

Figure 27:
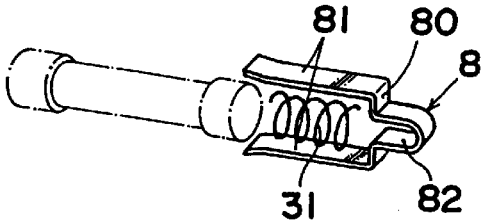
FIG. 27 is a perspective view showing a base plate for a spring seat of the car plug according to the present invention.

FIG. 27 shows a soldered portion 8 in connecting the cord wire 40 of the cord 4 to the internal electrode terminal 3 by soldering.

Figure 16:
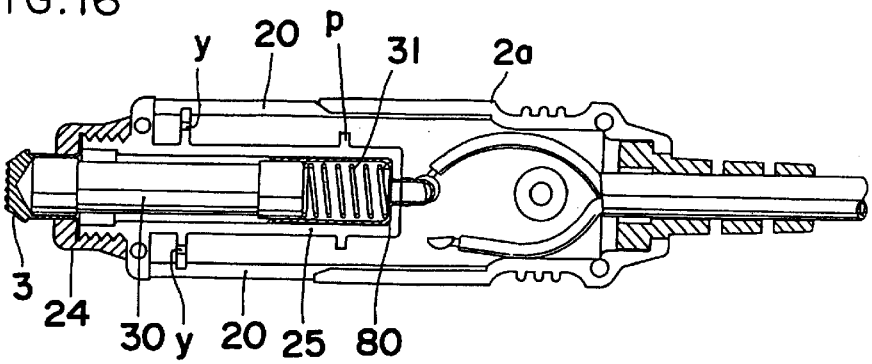
FIG. 16 is a plan view, partly broken-away, showing the car plug according to the present invention when bisecting a body of the car plug left and right.
Figure 17:
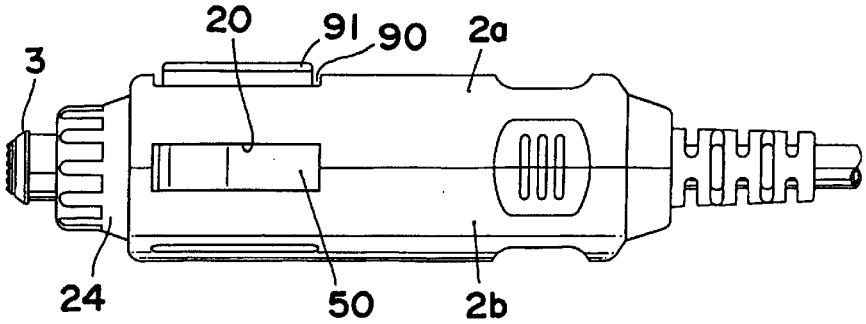
FIG. 17 is a side view showing the car plug according to the present invention when assembled.
Figure 19:
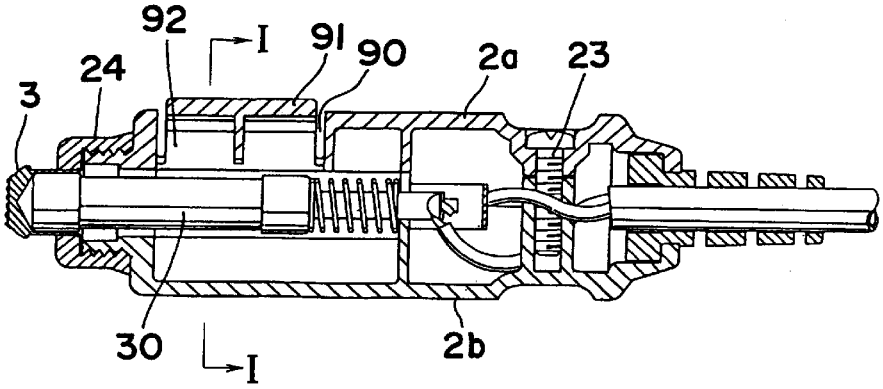
FIG. 19 is a longitudinal sectional side view showing the car plug according to the present invention.

The soldered portion 8 has a base plate 80 for supporting the spring 31 for urging to push out the internal electrode terminal 3 mounted to the tip end of the body 2 as being freely moved inwardly and outwardly by using the spring for pushing out the fuse 30 mounted in the fuse housing 25 in the body 2 as being moved freely inwardly and outwardly, as shown in FIG. 16. The base plate 80 is formed by the metal band plate to have channel-shaped bent guides 81 serving as a guide for the elastic movement of the spring 31 and also the inward or outward movement of the fuse 30. The base plate 80 has also a narrow channel-shaped portion 82 formed by bending the intermediate bottom portion of the base plate, which is used to support the spring 31, outwardly in a narrow channel-like shape. In this case, the narrow channel-like portion 82 is adapted for the soldered portion 8 for connection to the cord wire 40 of the cord 4 in the state that the narrow channel-like portion is extended through a small hole 26 formed in the bottom plate of the fuse housing 25.

With the above structure, the filled solder may be held in the narrow channel-shaped portion 82 in operation for connecting the cord wire 40 of the cord 4 to the internal electrode terminal by soldering, providing connection almost free from mistakes.

In the external electrode terminals 5, 5 applied to the case of assembling the body of the car plug A by connecting a front half 2*c* and a rear half 2*d*, which are obtained by bisecting the body in front and in rear, together by screwing as shown in FIGS. 12 and 13, there is provided a mounting seat 21 for the external electrode terminal 5. The mounting seat 21 is formed in the shape of a notched groove, which is communicated with the window hole 20, on the circumference of a thread portion of the front half 2*c* of the body 2. In this case, a plurality of external electrode terminals 5 may be mounted in a radial arrangement to the circumference of the body 2 by providing more mounting seats 21, 21 in a notched groove shape as shown by chain lines in FIG. 13 to mount the external electrode terminals 5 at four positions obtained by quadrisecting the circumference of the body. Thus, it is possible to stabilize the external electrode terminals 5, 5 according to the present invention in the turning direction when the body 2 is inserted into the socket 1.

Figure 28:
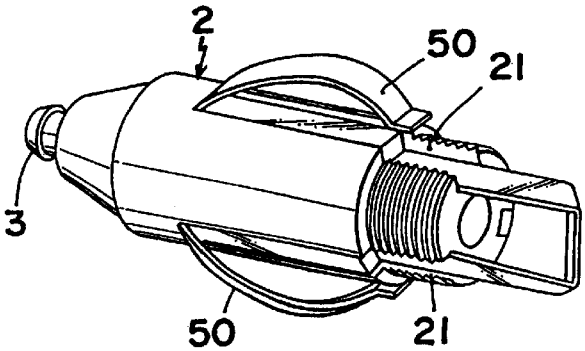
FIG. 28 is a perspective view showing the car plug according to the present invention when mounting the external electrode terminals at positions obtained by trisecting the circumference of the body.

When the body 2 of the car plug A is provided with mounting seats 21 at three positions obtained by trisecting the circumference of the body as shown in FIG. 28, the external electrode terminals may be mounted to the body 2 of the car plug A by mounting the external electrode terminals 5 to the mounting seats 21 such that three protuberant portions 50 are mounted to the three positions obtained by trisecting the circumference of the body. In this case, the body 2 may be fitted to the sockets 1, 1' in a stable state, instead.

Figure 29:
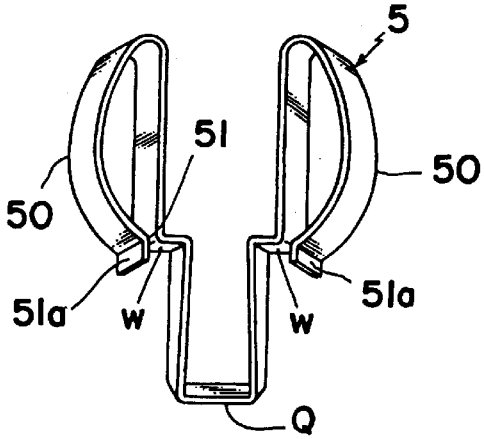
FIG. 29 is a perspective view showing a pair of external electrode terminals mounted to the car plug according to the present invention.

As to two of three protuberant portions 50, the rear end of the U-shaped bent portion is formed in the shape of a trapezoidal rear wall Q having a shorter upper side and a longer lower side as shown in FIG. 29 such that the tail end sides 5*b*, 5*b* extending from the inclined left and right sides of the rear wall to the protuberant portions 50, 50 are inclined inwardly in conformity with the inclined sides, in case of forming the protuberant portions 50, 50 at the opposite ends of the longer band plate z by bending the folded-back sides 5*a*, 5*a* obtained by bending the intermediate portion of the band plate in a U-like shape. Thus, two protuberant portions 50 may be formed at the ends of the single band plate z in the state that a pair of protuberant portions 50, 50 face each other such as to be projecting with a phase difference of about 120 degrees from the center of the body 2. Then, the pair of protuberant portions formed as described above may be mounted by fitting to the two mounting seats 21, 21.

Figure 30:
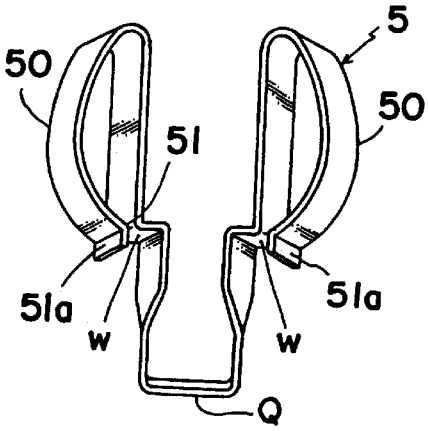
FIG. 30 is a perspective view showing another embodiment of the external electrode terminal of FIG. 29.
Figure 31:
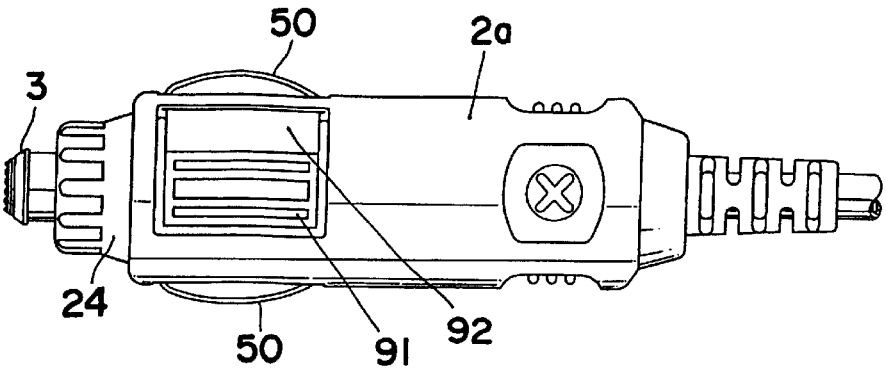
FIG. 31 is a plan view showing the car plug according to the present invention when assembled.

When the rear end of the U-shaped bent portion of the single band plate z is formed in the shape of a rectangular or square rear wall Q to form the tail end sides 5*b*, 5*b* extending from the rear wall as being inclined inwardly as shown in FIG. 30, it is also possible to form the pair of protuberant portions 50, 50 from the single band plate z so as to face each other with a phase difference of about 120 degrees.

Since the protuberant portion 50 of the external electrode terminal 5 mounted to the remaining mounting seat 21 among the three mounting seats 21 provided at the three positions obtained by trisecting the circumference of the body 2 may be used only to stabilize the body 2, connection to the cord wire 41 of the cord 4 is not required.

The protuberant portion 50 used only to stabilize the body 2 may be mounted as a non-elastic rigid body to the mounting seat 21, or formed by a resin material in the shape of a projection extending from the circumference of the body 2 at a portion obtained as one of the three positions obtained by trisecting the circumference of the body 2 in case of forming the body 2 by the resin material.

In FIGS. 16 to 20, reference numeral 91 denotes a means for preventing the lateral vibrations produced by the movement of the body 2 in the turning direction when assembling the body by face-to-face connecting the left half 2*a* and the right half 2*b*, which are obtained by bisecting the body 2 left and right, together to mount the pair of external electrode terminals 5, 5 to the body such that the external electrode terminal may face each other.

This means has a projection 91 brought into contact with the inner wall surface of the socket 1. The projection 91 is placed in a notched hole 90. The notched hole 90 is provided in a circumferential intermediate portion between the window holes 20, 20 respectively formed at the left and right sides of the surface of bisection of the body 2 to expose the protuberant portions 50 of the external electrode terminals 5 to the outside. The notched hole 90 is set to be placed as being overlapped with the window holes 20 in the circumferential direction in the peripheral wall of both or one of the left half 2*a* and the right half 2*b* individually formed in case of assembling the body 2 in the axially cylindrical shape by the resin material with the cap 24 and the connection screw 23 by individually forming the left half 2*a* and the right half 2*b*, which are obtained by bisecting the body 2 left and right through the surface of bisection in the axial direction, by the resin material as shown in FIGS. 16 to 20. In this case, the left and right side edges of the projection 91 are connected to a binding member 92 projecting in the shape of a tongue from one of the left and right side edges of the notched hole 90 to support the projection 91 with the binding member 92. Also, the projection 91 is structured to be moved freely inwardly and outwardly with respect to the notched hole 90 in the state that the binding member 92 is bent by the elasticity of the resin material by forming the projection 91 and the binding member 92 to be united as one body by the resin material used to form the left half 2*a* and the right half 2*b* of the body 2.

Figure 32:
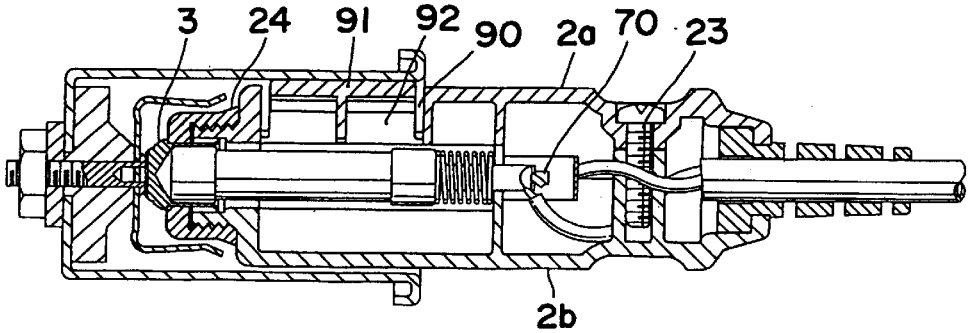
FIG. 32 is a longitudinal sectional view showing the car plug according to the present invention when inserted into the somewhat larger socket.
Figure 33:
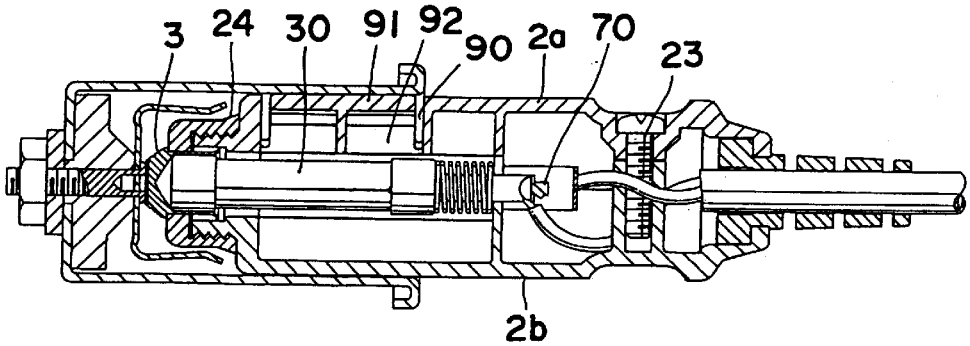
FIG. 33 is a longitudinal sectional side view showing the car plug according to the present invention when inserted into the somewhat smaller socket.

Thus, the lateral vibrations may be prevented by the above structure by supporting the body 2 with three contact points, that is, the pair of external electrode terminals 5,5 and the projection 91 in the state that the binding member 91 is bent to bring the body 2 into pressure contact with the inner wall surface of the somewhat larger socket 1' of the vehicle body for the European automobiles and the somewhat smaller socket 1 of the vehicle body for the Japanese and U.S. automobiles as shown in FIGS. 32 and 33, when the body 2 of the assembled car plug A is inserted into the socket 1 and the socket 1'.

The projection 91 may be also formed as a rigid body projecting as one body from a predetermined position of the peripheral wall of the left half 2*a* or the right half 2*b* in case of forming the left half 2*a* and the right half 2*b* of the body 2 by the resin material.

Figure 34:
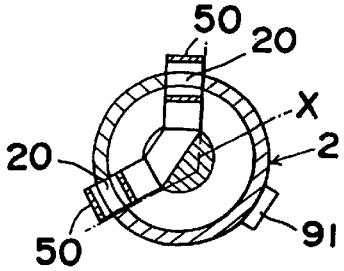
FIG. 34 is a longitudinal sectional front view showing the car plug according to the present invention when mounting a pair of external electrode terminals at two of three positions obtained by trisecting the circumference of the body, and a projection at the remaining position.

In case of assembling the body 2 by forming the left half 2*a* (one half) and the right half 2*b* (the other half), which are obtained by bisecting the body 1 left and right in the axial direction, by the resin material individually and then face-to-face connecting the left half and the right half together such that the pair of protuberant portions 50, 50 formed at the opposite ends of the longer band plate z may face each other with the phase difference of about 120 degrees as shown in FIGS. 29 and 30, there is provided a surface of bisection S to bisect the body 2 into one half 2*a* and the other half 2*b*. The surface of bisection is obtained by bisecting the body 2 along a line of bisection at an angle of about 120 degrees from the center position of the body 2, as viewed in the axial direction of the body 2 as shown in FIG. 34. In this case, by assembling the body by face-to-face connecting one half and the other half together, the pair of external electrode terminals 5, 5 formed at the opposite ends of the single band plate z may be mounted to two of three positions obtained by trisecting the circumference of the body such that the crank-shaped bent portion to form the support base w is supported with a projecting base portion p in the state that the tail end sides 5*b* of the external electrode terminals 5 are fitted to the mounting seats y, y formed in the fit-grooved shape on the left half 2*a* (one half) and the right half 2*b* (the other half) of the body 2 as shown in FIG. 21.

In this case, there may be provided a rigid projection 91 at the remaining position among the three positions obtained by trisecting the circumference of the body using a resin material also used to form one half 2*a* or the other half 2*b*.

As has been described in the foregoing, when the car plug A according to the means of the present invention is inserted into the cigar lighter socket 1' having the somewhat larger inside diameter and mounted in the European automobiles, the free end 51 of the protuberant portion 50 is supported with the support base surface a in collision therewith to exert a predetermined spring pressure, resulting in a state to be adapted for the somewhat larger socket 1' for the European automobiles. On the other hand, when the car plug is inserted into the somewhat smaller cigar lighter socket 1 mounted in the Japanese and U.S. automobiles, the free end 51 is supported with the lower support base surface b to exert the predetermined spring pressure in the state that the protuberant portion 50 is pressed forcibly to slip down the free end 51 from the support base surface a to the lower support base surface b. Thus, switch-over between the state to be adapted for the somewhat larger socket 1' for the European automobiles and the state to be adapted for the somewhat smaller socket for the Japanese and U.S. automobiles may be automatically made during insertion of the car plug into the socket 1 and the socket 1'.

What is claimed is:

1. A car plug, comprising:

a body; and an external electrode terminal formed by an elastic, conductive metal band plate and incorporated in the body;

wherein said external electrode terminal has a protuberant portion structured that a tail end of said protuberant portion is formed to extend continuously from a tail end side of the band plate, and a tip end of said protuberant portion is formed in the shape of a free end freely movable toward the center of the body;

a higher support base surface is provided in the body to support the free end of the protuberant portion in collision with the free end at a position facing said free end pressed in the radial direction of the body by an inner wall surface of a larger socket mounted in a vehicle body for European automobiles when the body is inserted into said larger socket; and a lower support base surface lower than said higher support base surface by one step is provided at a position to support the free end slipped down from said higher support base surface by extension of the protuberant portion toward the free end in a state that the protuberant portion is pressed forcibly in the radial direction of the body by an inner wall surface of a smaller cigar lighter socket mounted in a vehicle body for Japanese and U.S. automobiles when the body is inserted into said smaller socket.

2. A car plug according to claim 1, wherein the external electrode terminal formed by the metal band plate is mounted to the body such that the side having the free end of the protuberant portion of said external electrode terminal is facing the tail end of the body.

3. A car plug according to claim 1, wherein the protuberant portion having the free end is formed by bending a folded-back side obtained by folding back the metal band plate for formation of the external electrode terminal from a longitudinal portion of the metal band plate to face the folded-back side to the tail end side of said band plate after being subjected to bending outwardly, and the higher support base surface and the lower support base surface lower than said higher support base surface to support the free end are formed at the tail end side of the band plate by bending a portion facing the free end of the protuberant portion.

4. A car plug according to claim 1, wherein the protuberant portion of the external electrode terminal formed by the metal band plate is composed of a higher protuberant portion located at the side of the free end and a lower protuberant portion located at a position opposite to the free end are in parallel arrangement in the longitudinal direction of the band plate, and the higher protuberant portion is set to an extension level to exert a predetermined spring pressure in the state that the higher protuberant portion is pressed by the inner wall surface of the larger socket to support the free end with the support base when the body is inserted into said larger socket, while the lower protuberant portion is set to an extension level to exert the predetermined spring pressure so as to bring the lower protuberant portion into pressure contact with the inner wall surface of the smaller socket when the free end is supported with the lower support base surface in the state that the higher protuberant portion is pressed forcibly by the insertion of the body into the smaller socket to slip down the free end from the higher support base surface to the lower support base surface.

5. A car plug according to claim 1, wherein the protuberant portion is formed at a folded-back side obtained by folding back the metal band plate for formation of the external electrode terminal from a longitudinal portion of the metal band plate to face the folded back side to the tail end side of the band plate in parallel after being subjected to bending outwardly, and said external electrode terminal is mounted to the body by fitting the side edge of the tail end side of the band plate facing the protuberant portion to each of a plurality of mounting seats formed in a fit-grooved shape in a left half and a right half formed in the shape obtained by bisecting the body left and right.

6. A car plug according to claim 1, wherein said external electrode terminal comprises a pair of external electrode terminals formed as one body to have the protuberant portions respectively at folded-back sides obtained by bending an intermediate portion of the metal band plate for formation of the external electrode terminals in a U-like shape, the terminals having opposite ends that face each other, and then folding back the opposite ends after being subjected to bending outwardly, and said external electrode terminals are mounted to the body.

7. A car plug according to claim 1, wherein the body is assembled by forming a left half and a right half, which are obtained by bisecting the body left and right, individually by a resin material, and then face-to-face connecting said left half and said right half together, said external electrode terminal comprises two external electrode terminals formed by the metal band plate and mounted to said body to face each other with an angular difference of about 180 degrees in the circumferential direction of said body such that the protuberant portions of said external electrode terminals are placed so as to extend through window holes formed in a surface of contact between said left half and said right half, and a notched hole having left and right side edges is provided at an intermediate portion between the window holes in the circumferential direction of the body in both or one of the left half and the right half of said body, while a binding member projecting in the shape of a tongue from one of the left and right side edges of said notched hole and a projection supported with the binding member to project outwardly from the circumference of said body through said notched hole are formed by the resin material for formation of said body so as to extend continuously as one body from the left half or the right half of said body.

8. A car plug according to claim 1, wherein the external electrode terminal comprises a pair of external electrode terminals formed by the metal band plate and mounted to the body such that the protuberant portions of said external electrode terminals project from two of three positions obtained by trisecting the circumference of the body, and a projection extending from the outer surface of said body to a predetermined level is mounted to the remaining portion of said three positions as being fixed to said body.

9. An external electrode terminal of a car plug, comprising:

protuberant portions formed by an elastic metal band plate;

wherein said protuberant portions are formed by bending folded-back sides obtained by folding back said metal band plate from a longitudinally intermediate portion of the band plate in a two-folded shape to have opposite ends that face each other and then folding back the opposite ends toward the intermediate portion to face the folded-back sides to tail end sides of said band plate after being subjected to bending outwardly, and the two-folded intermediate portion of the band plate has a rear end side in the shape of a trapezoidal rear wall having a shorter upper side, a longer lower side and two inclined sides, the tail end sides of said band plate extend continuously from said rear wall and are inclined inwardly in conformity to the inclined sides of said rear wall such that the protuberant portions face each other at an angle of about 120 degrees.

10. An external electrode terminal of a car plug, comprising:

protuberant portions formed by an elastic metal band plate;

wherein said protuberant portions are formed by bending folded-back sides obtained by folding back said band plate from a longitudinally intermediate portion in a two-folded shape to have opposite ends that face each other and then folding back the opposite ends toward the intermediate portion so as to face the folded-back sides to tail end sides of said band plate after being subjected to bending outwardly, and the tail end sides extend continuously from the intermediate portion obtained by folding back said band plate in a two-folded shape and are bent to be inclined inwardly such that said protuberant portions face each other at an angle of 120 degrees.

* * * * *